US006349714B1

(12) United States Patent
Hurley et al.

(10) Patent No.: US 6,349,714 B1
(45) Date of Patent: Feb. 26, 2002

(54) COOKING RANGE AND CONTROL ASSEMBLY AND BURNER THEREFOR

(75) Inventors: James R. Hurley, E. Weymouth; Frederick E. Becker, Reading; Anthony Duca, Waltham, all of MA (US)

(73) Assignee: Gas Research Institute, Des Plaines, IL (US)

( * ) Notice: Subject to any disclaimer, the term of this patent is extended or adjusted under 35 U.S.C. 154(b) by 0 days.

(21) Appl. No.: 09/521,809

(22) Filed: Mar. 9, 2000

(51) Int. Cl.[7] ..... F24C 3/00

(52) U.S. Cl. ..... 126/39 J; 126/21 R; 126/39 K; 126/299 R; 431/326; 431/328

(58) Field of Search ..... 126/39 J, 39 K, 126/39 R, 21 R, 39 E, 299 R, 273 R, 39 BA, 214 A; 431/326, 328, 329, 256, 242, 284, 7, 170

(56) References Cited

U.S. PATENT DOCUMENTS

| | | | | |
|---|---|---|---|---|
| 2,921,176 A | | 1/1960 | Scofield | 219/37 |
| 3,258,058 A | | 6/1966 | L'Herault et al. | 158/116 |
| 3,291,188 A | | 12/1966 | Partiot | 158/116 |
| 3,468,298 A | * | 9/1969 | Teague, Jr. et al. | 431/328 |
| 3,698,378 A | * | 10/1972 | Rosenberg et al. | 431/39 J |
| 4,201,184 A | * | 5/1980 | Scheidler et al. | 126/39 J |
| 4,960,377 A | | 10/1990 | Nunes et al. | 431/12 |
| 5,360,490 A | * | 11/1994 | Nelson | 431/329 |
| 5,989,013 A | * | 11/1999 | Gray | 431/326 |

FOREIGN PATENT DOCUMENTS

| | | | |
|---|---|---|---|
| GB | 2073868 | * 10/1981 | 431/329 |

* cited by examiner

*Primary Examiner*—James C. Yeung
(74) *Attorney, Agent, or Firm*—Pauley Peterson Kinne & Fejer

(57) ABSTRACT

A burner for a heat supplying device includes a substrate of thermally insulating material, the substrate defining a plurality of openings therethrough for flow of an air/gas mixture therethrough from a first side of the substrate to a second side of the substrate for combustion adjacent to the second side of the substrate. The burner further includes a high temperature metal wire disposed on the second side of the substrate and projecting outwardly therefrom, and a cover layer of heat transmissive material overlying the metal wire to provide a support surface on the heat-supplying device for supporting a heat-consuming item.

35 Claims, 11 Drawing Sheets

COOKING RANGE AND CONTROL ASSEMBLY AND BURNER THEREFOR

BACKGROUND OF THE INVENTION

1. Field of the Invention

The invention relates to heating devices and is directed more particularly to cooking ranges of the type used in domestic and commercial kitchens.

2. Description of the Prior Art

It appears to be generally recognized that gaseous fuel (natural gas, propane, methane, and the like; hereinafter "gas") stoves provide superior cooking capabilities. It also appears increasingly recognized that smooth-top electric stoves present the most pleasing appearance and are the easiest to clean, important factors in selection of ranges for both domestic and commercial kitchens.

Accordingly, there is a need for a cooking range fueled by gas but having the smooth-top structure and appearance.

SUMMARY OF THE INVENTION

An object of the invention is, therefore, to provide a heat supplying device, such as a cooking range, having a burner adapted to operate on a gaseous fuel and which, in combination with a cover member of heat transmissive material, presents an aesthetically pleasing and easy to clean smooth top for supporting items to be heated or cooked.

A further object of the invention is to provide a device as described immediately above, wherein a negative pressure is maintained in the burner so as to draw off combustion gases and to draw the cover member into engagement with the burner to effect a gas-tight seal therebetween.

A still further object of the invention is to provide a control assembly for the above-described heat supplying device, to select the intensity of heat supplied thereby.

Still another object of the invention is to provide a burner which operates on a gaseous fuel, but which permits use of a smooth cover of heat transmissive material which provides an aesthetically pleasing and easy-to-clean top surface for supporting items to be heated or cooked.

With the above and other objects in view, as will hereinafter appear, a feature of the present invention is the provision of a cooking range comprising a support structure for supporting at least one burner, a burner mounted on the support structure, the burner comprising a chamber for receiving a gas and air mixture, a substrate having a bottom surface in part defining the chamber and having apertures therethrough for passage of the gas and air mixture therethrough, a combustion chamber defined in part by a top surface of the substrate, an igniter in the combustion chamber for igniting the gas and air mixture, and a high temperature metal or refractory fibers wire disposed proximate the top surface of the substrate for radiating heat. The range further comprises a cover member of heat transmissive material overlying the metal wire and providing a support surface for items to be heated.

In accordance with a further feature of the invention, there is provided a heat supplying device comprising a housing, a gas supply inlet and valve therefor, and an air supply inlet and valve therefor. The device further comprises a burner fixed in the housing and comprising a substrate of either a thermally insulating, thermally conductive, or a combination material, the substrate defining a plurality of openings therethrough for flow therethrough of a mixture of air from the air supply inlet and gas from the gas supply inlet, the flow extending from a first side of the substrate to a second side of the substrate for combustion adjacent the second side of the substrate, and high temperature metal or refractory fibers wire disposed adjacent the second side of the substrate and projecting outwardly therefrom. The device still further comprises a cover of heat transmissive material disposed on the housing and overlying the metal or refractory fibers wire to provide a support surface on the heat-supplying device for supporting a heat-consuming item.

In accordance with a further feature of the invention, there is provided a cooking range comprising support structure for supporting at least one burner, a burner mounted on the support structure, the burner being provided with a combustion chamber for housing combustion of a fuel, and a cover member of heat transmissive material overlying the combustion chamber and providing a support surface for items to be heated. The range further comprises an exhaust blower in communication with the combustion chamber to draw exhaust gasses from the combustion chamber, and for maintaining negative pressure in the combustion chamber to pull the cover member toward the burner to sealingly engage a peripheral portion of the burner.

In accordance with a still further feature of the invention, there is provided a cooking range comprising a support structure for supporting at least one burner, a gas-fueled burner mounted on the support structure, the burner being provided with a combustion chamber for receiving a gas and air mixture, an igniter mounted in the combustion chamber for igniting the gas and air mixture to provide a flame, and a mixing chamber for receiving gas and air from a gas inlet and an air inlet, respectively, for mixing the gas and air, and discharging the mixture to a conduit in communication with the combustion chamber. The range further comprises a control assembly for reducing the flame from a selected intensity to a selected lesser intensity and for increasing the flame from the lesser intensity to a selected greater intensity, the control assembly comprising an actuator in communication with a gas valve and an air inlet valve, the actuator being operative, upon operation to reduce the flame intensity, to progressively reduce the flow rate of gas through the gas inlet to the mixing chamber to progressively reduce the intensity of the flame to about 10% of a maximum intensity, and upon further operation to reduce the flame intensity, is operative to substantially reduce the flow rate of air through the air inlet and further reduce the flow rate of gas through the gas inlet to the mixing chamber to further reduce the intensity of the flame, the actuator being operative, upon operation to increase the intensity of the flame, to increase the flow rate of gas through the gas inlet to the mixing chamber to progressively increase the intensity of the flame to about 40% of the maximum intensity, and upon further operation to increase the flame intensity, is operative to further increase the flow rate of gas through the gas inlet and to substantially increase the flow rate of air through the air inlet and to the mixing chamber to further increase the intensity of the flame.

In accordance with another feature of the invention, there is provided a control assembly for selectively varying the intensity of a flame produced by combustion of a gas and air mixture by selectively varying flow rate of gas to a mixing chamber, and varying flow rate of air to the mixing chamber. The control assembly comprises an actuator operable in a first direction to decrease the flame intensity and in a second direction to increase the flame intensity, a gas valve in the gas conduit in communication with the mixing chamber for varying flow rate of gas to the mixing chamber, and an air valve in communication with the mixing chamber and adapted to vary flow of air to the mixing chamber, wherein upon operating the actuator in the first direction, the actuator effects progressive closing of the gas valve to progressively decrease the flow rate of gas to the mixing chamber, and wherein upon further operation of the actuator in the first direction, the actuator reaches a point at which the actuator effects operation of the air valve to close off at least a portion of a first air inlet orifice to the mixing chamber and substitute therefor a smaller second air inlet orifice, to substantially reduce the flow rate of air to the mixing chamber, and wherein upon operating the actuator in the second direction, the actuator effects progressive opening of the gas valve to progressively increase the flow rate of gas to the mixing chamber, and wherein upon further operation of the actuator in the second direction, the actuator reaches the point at which the actuator effects operation of the air valve to remove the second air inlet orifice from communication with the mixing chamber and leave the larger first air inlet orifice in communication with the mixing chamber, to substantially increase the flow rate of air to the mixing chamber.

In accordance with another feature of the invention, there is provided a burner for a heat-supplying device, the burner comprising a substrate of either thermally insulating or conductive, or combination material, the substrate defining a plurality of openings therethrough for flow of a mixture of gas and air therethrough from a first side of the substrate to a second side of the substrate for combustion adjacent to the second side of the substrate, high temperature metal or refractory fibers wire disposed on the second side of the substrate and projecting outwardly therefrom, and a cover of heat transmissive material overlying the metal wire and defining a support surface of the heat-supplying device for supporting a heat-consuming item.

The above and other features of the invention, including various novel details of construction and combinations of parts, will now be more particularly described with reference to the accompanying drawings and pointed out in the claims. It will be understood that the particular device embodying the invention is shown by way of illustration only and not as a limitation of the invention. The principles and features of this invention may be employed in various and numerous embodiments without departing from the scope of the invention.

BRIEF DESCRIPTION OF THE DRAWINGS

Reference is made to the accompanying drawings in which is shown an illustrative embodiment of the invention, from which its novel features and advantages will be apparent.

In the drawings.

DESCRIPTION OF THE PREFERRED EMBODIMENT

Figure 1:
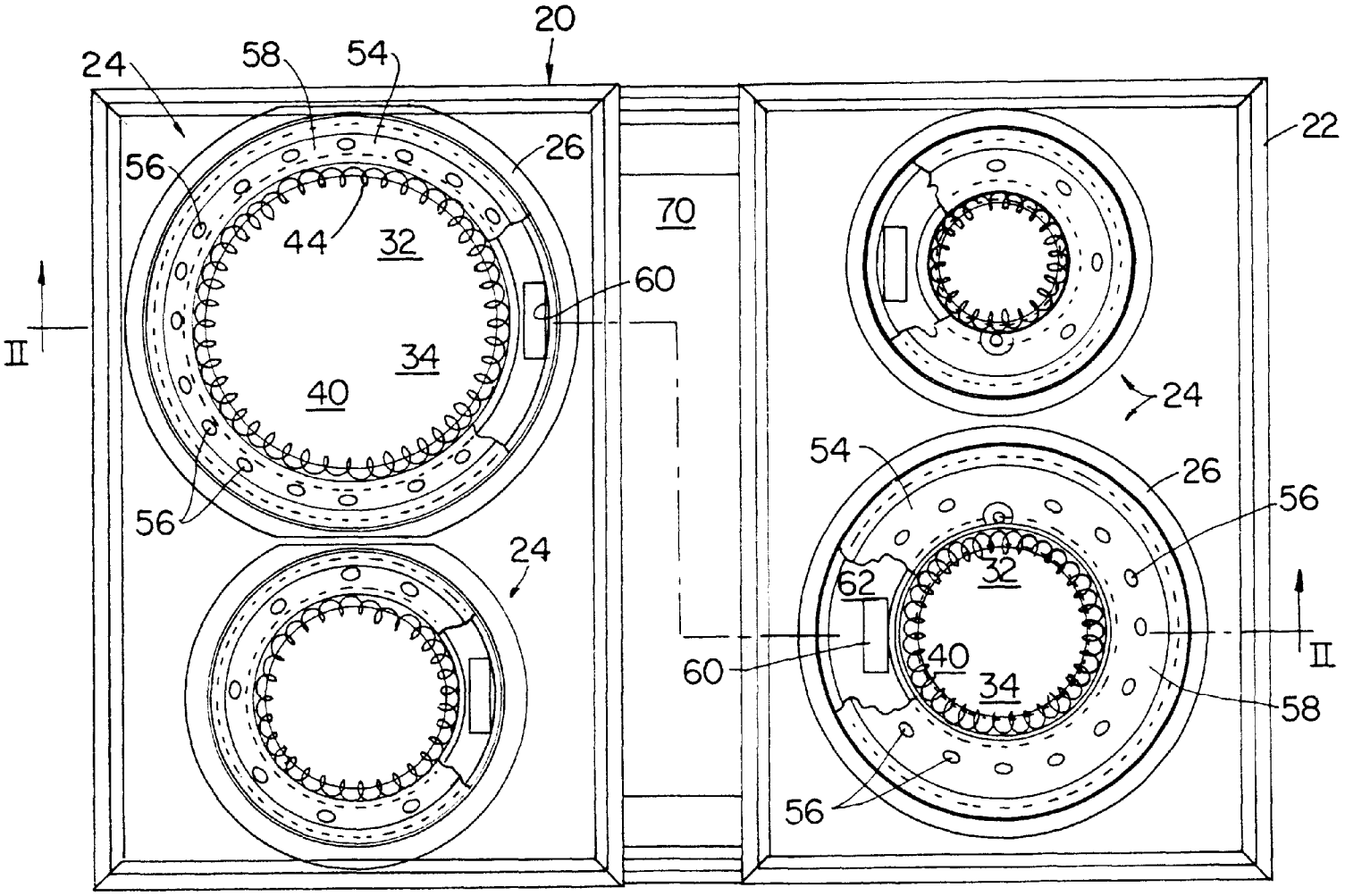
FIG. 1 is a top view, broken away, of one form of cooking range, with top cover removed, illustrative of an embodiment of the invention.
Figure 2:
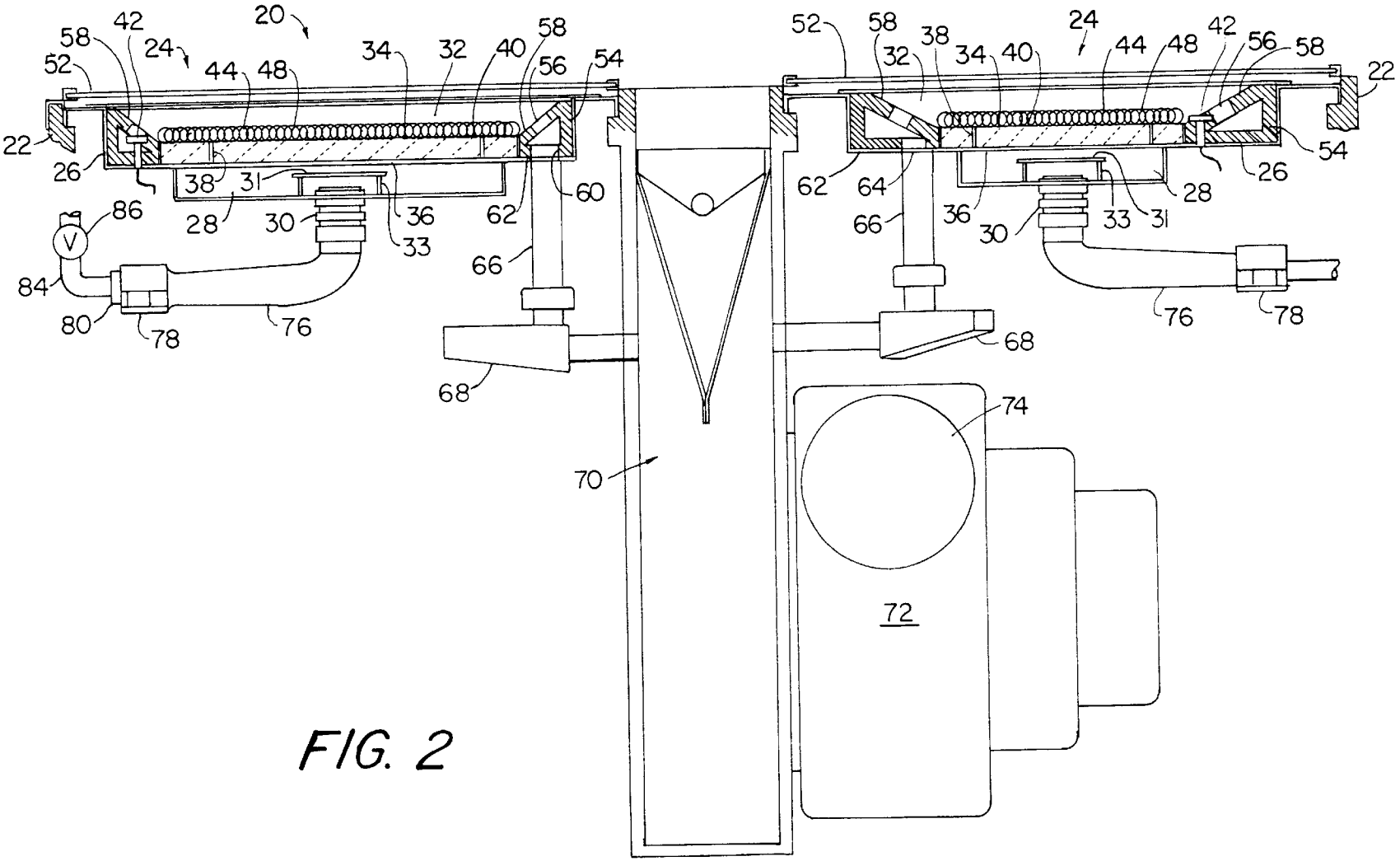
FIG. 2 is a generally sectional partly diagrammatical view, taken along line II—II of FIG. 1.
Figure 12:
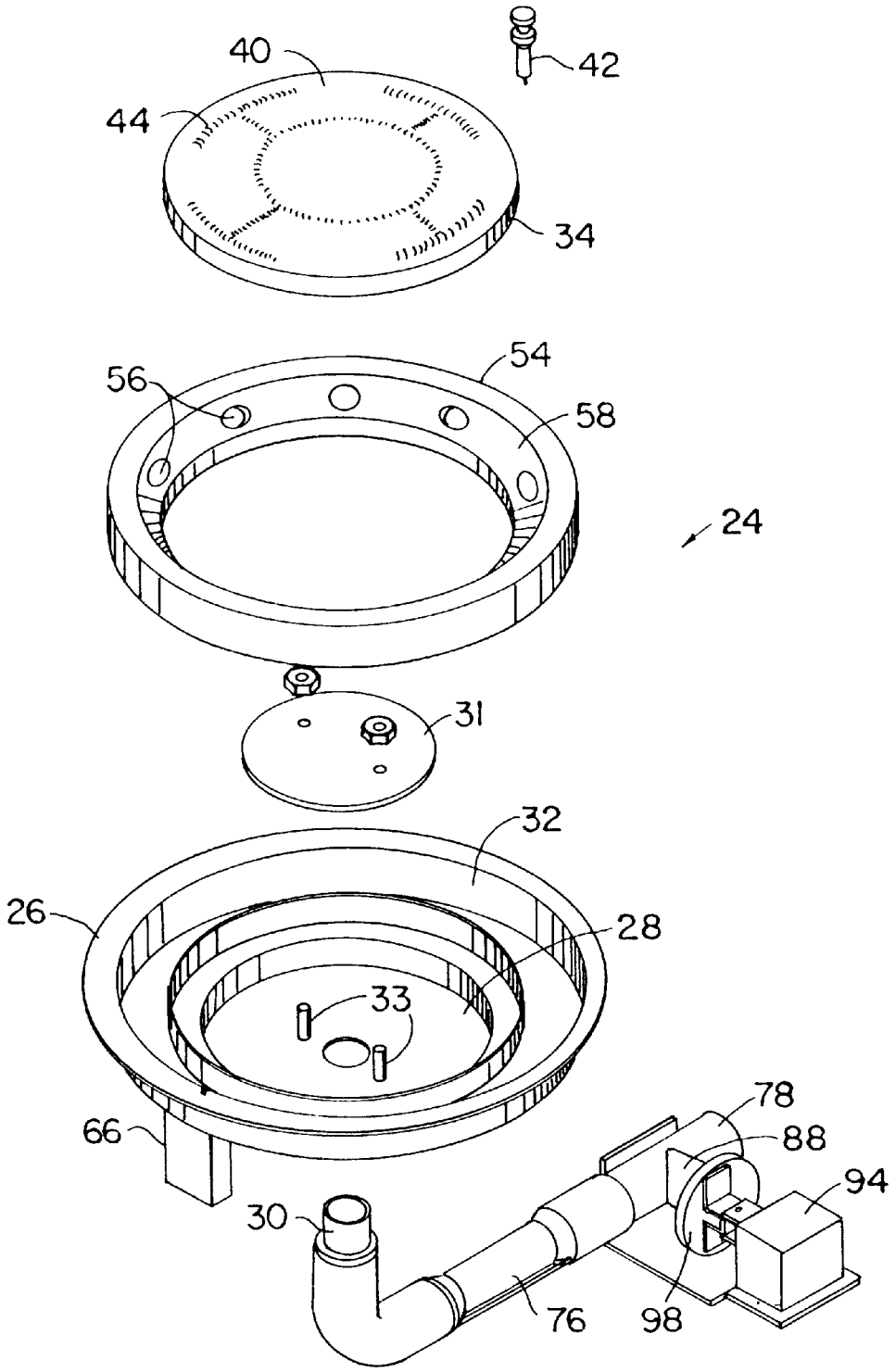
FIG. 12 is an exploded perspective view of a burner assembly in combination with the gas/air mixing device.

Turning to FIGS. 1, 2 and 12, there is shown a heat supply device 20, such as a cooking range, including a support structure 22 for supporting one or more burners 24. The burners 24 are mounted on the support structure 22, each comprising a shell 26 defining in part a chamber 28 for receiving a gas and air mixture from fuel mixture inlet 30 fixed to the shell 26 (FIG. 2). The shell 26 further defines in part a combustion chamber 32 in which a flame is sustained as desired.

A baffle 31, supported by pins 33 in the chamber 28 is spaced from the fuel mixture inlet 30 and serves to disperse the fuel mixture throughout the chamber 28.

Figure 4:
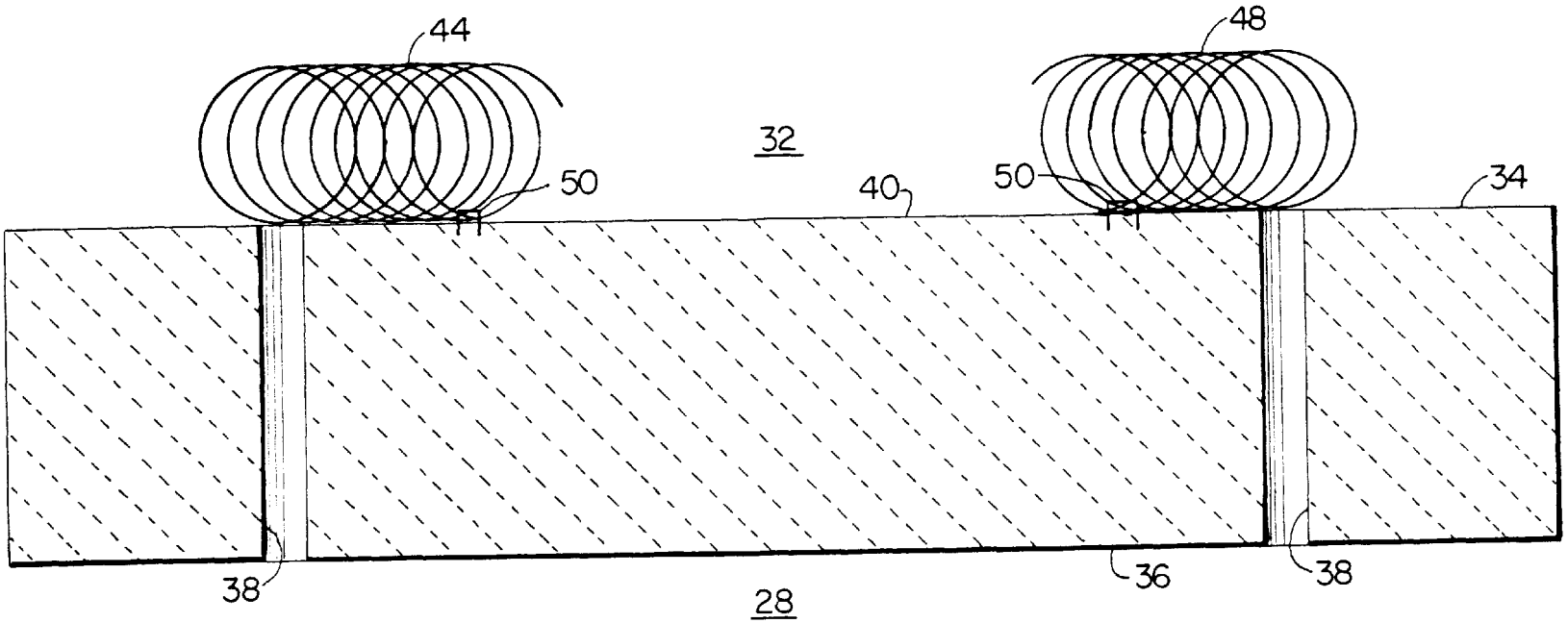
FIG. 4 is a partly sectional, partly elevational, view of an alternative embodiment of burner portions of the range of FIGS. 1 and 2.
Figure 5:
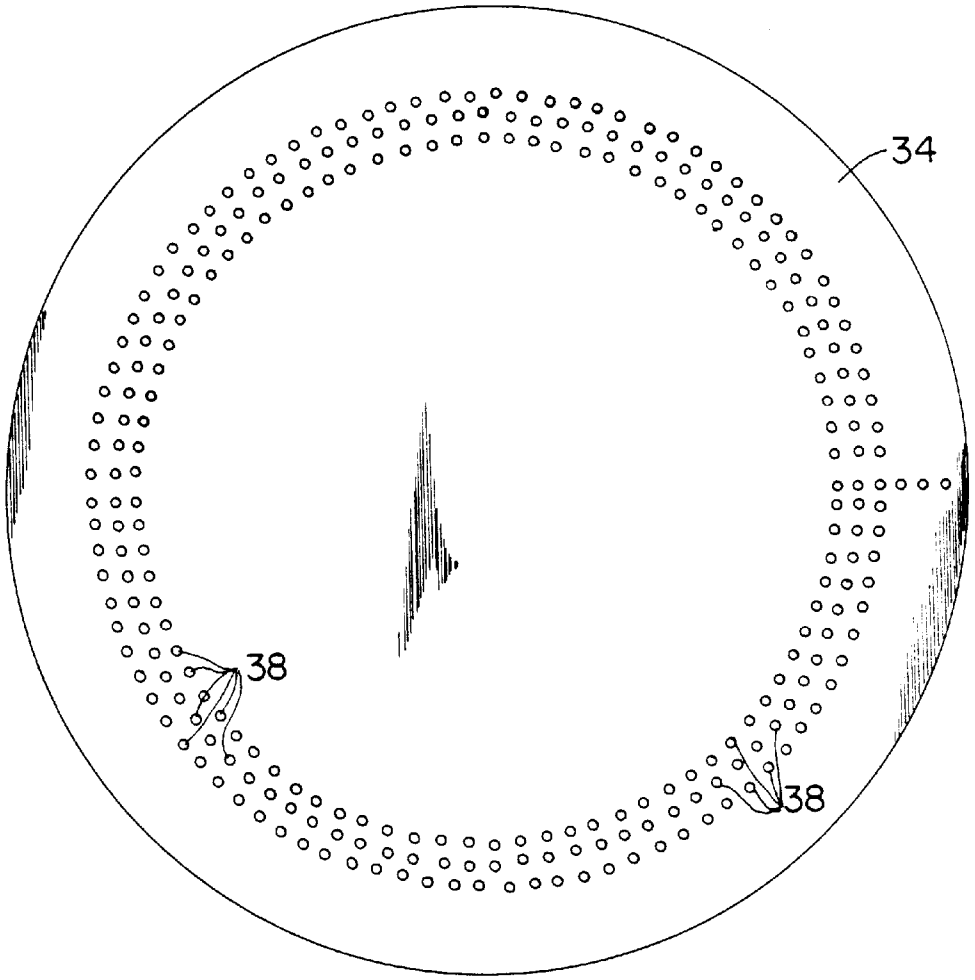
FIG. 5 is a bottom view of a substrate portion of a burner of the type shown in FIGS. 3 and 4.

A substrate 34, of a rigid, high temperature material having good thermal insulating characteristics, preferably low density alumina oxide, corderite, compressed alumina fibers, or the like, is disposed in the shell 26 and overlies the gas and air mixture receiving chamber 28, a bottom surface 36 of the substrate 34 defining in part the chamber 28, and a top surface 40 of the substrate 34 defining in part the combustion chamber 32. The substrate material may be of a thermally insulating material, or of a thermally conductive material, or of a combination of thermally insulating and thermally conductive materials. The substrate 34 is formed to the desired shape of the burner, including circular, as shown herein, and is about ½ to ¾ inch thick. The substrate 34 is provided with a multiplicity of apertures 38 (FIGS. 3–5) extending therethrough, which permit passage of the gas and air mixture from the chamber 28 to the combustion chamber 32. An igniter 42 (FIGS. 2 and 12) in the combustion chamber 32 is operative to ignite the gas and air mixture in the combustion chamber 32.

In FIGS. 2 and 12, there are shown known igniters 42 mounted adjacent to, but slightly spaced from, a high temperature metal wire 44. An arc from the igniter 42 to the metal wire 44 serves to ignite gaseous fuel present in the combustion chamber 32. Alternatively, a portion of the metal wire 44 may be connected to a source of electrical energy sufficient to produce a spark from one coil or loop of the wire 44 to an adjacent coil or loop to ignite the fuel present. In another alternative, one or more portions of the metal wire 44 can serve as a "glow wire" portion. Voltage applied to the glow wire portion of the metal wire 44 quickly heats that portion of the wire to ignition temperature, to ignite the gaseous fuel present.

Figure 3:
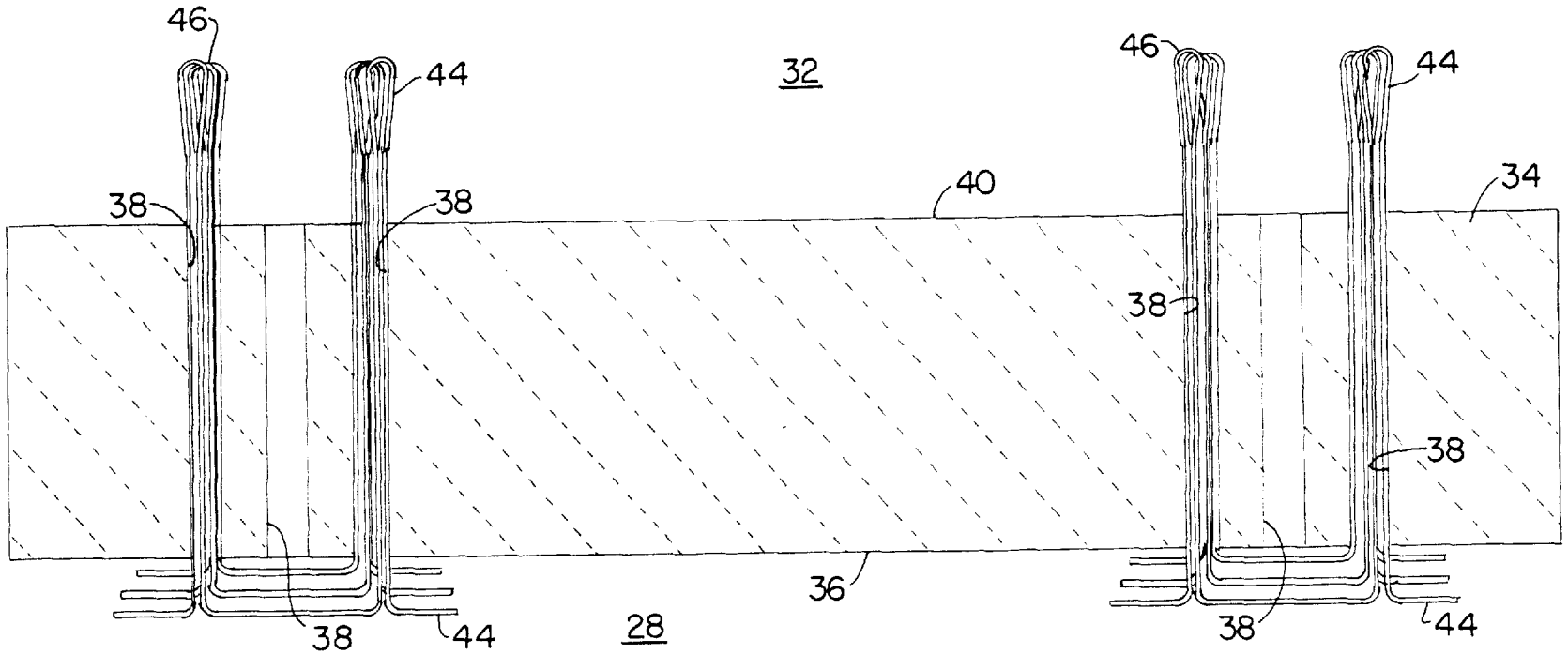
FIG. 3 is a partly sectional, partly elevational, view of one form of burner illustrative of a burner portion of the range of FIGS. 1 and 2.

A high temperature metal wire 44 is disposed in the combustion chamber 32 and is fixed to the substrate 34. The wire 44 preferably is of kanthal, chromel, nichrome, or the like, and is of a diameter of about 0.005–0.020 inch. The wire may be woven through the apertures 38 and form a series of loops 46 (FIG. 3). The wire 44 may be in the form of a coil 48 fixed to the substrate by staples 50 (FIG. 4), or the like, or woven through the apertures 38, or embedded (not shown) in the substrate 34 sufficiently to anchor the wire on the substrate. Alternatively, the wire may be in the form of a flat ribbon (not shown), rather than a round wire. Alternatively, the metal wire may be replaced with refractory or ceramic fibers.

A cover member 52 (FIG. 2) of heat transmissive material closes the combustion chamber 32 and overlies the metal wire 44. The cover member 52 may be of a glass-ceramic material, preferably "Vicor" produced by Corning Glass, Inc., or a quartz glass material, which permits continuous use at an operating temperature of about 1800° F. Alternatively, Ceran High Transmission material is acceptable.

Referring to FIGS. 1, 2, and 12, it will be seen that the illustrative burners 24 are each provided with an insulation ring 54 of high temperature insulation material, and which, for a round burner, is annularly shaped. Each insulation ring 54 is provided with a series of openings 56 in an upper wall 58 thereof and with an exhaust opening 60 (FIGS. 1 and 2) in a bottom wall 62 thereof. Each of the exhaust openings 60 is aligned with an opening 64 in the shell 26 which, in turn, is aligned with an exhaust tube 66 (FIGS. 2 and 12). The exhaust tubes 66 of front and rear burners are in communication with a manifold 68 (FIG. 2). The mainfolds 68 are in communication with a central channel 70 extending substantially from front-to-rear of the range. A blower 72 is operative to draw combustion gasses from the combustion chambers 32 of the burners 24, through the insulation rings 54, exhaust tubes 66, and channel 70, and exhaust the gasses through an exhaust outlet 74, usually leading out of the building in which the range is located. Thus, the burners 24 are fully vented; no combustion gases are discharged into the room or building, or other enclosure, in which the cooking range is disposed.

In addition to exhausting the combustion gases, the blower 72 induces a negative pressure in the combustion chambers 32 of about −0.1 to −0.9 inch $H_2O$. The negative pressure draws the cover member 52 toward the combustion chamber and into firm engagement with peripheral portions of the burner shells 26 to effect a seal therebetween. Thus, combustion gases do not escape between the burners 24 and cover members 52, but rather are drawn into the exhaust path 60, 64, 66, 68, 70, 72 and 74.

Figure 6:
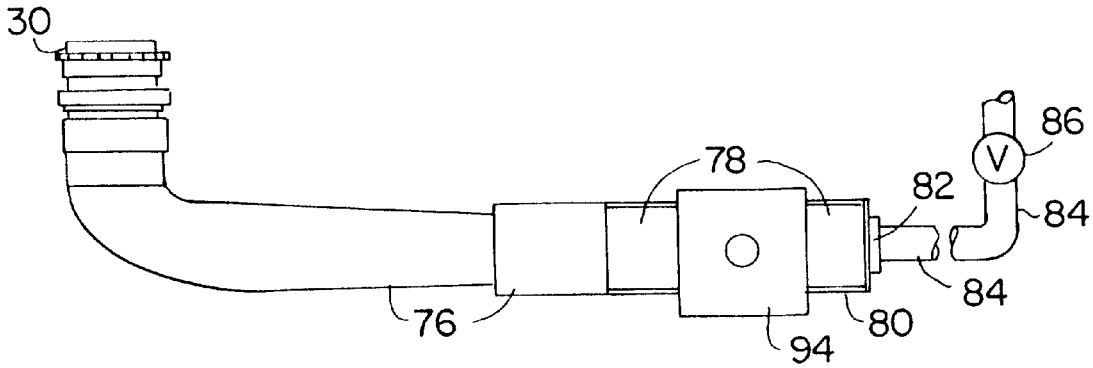
FIG. 6 is a side elevational, partly diagrammatic view of a gas/air mixing device and "turn down" assembly.

Referring to FIGS. 2, and 6–8, it will be seen that the fuel mixture inlet 30 is in communication with a gas and air mixing tube 76 which, in turn, is in communication with a gas and air entry chamber 78. The entry chamber 78 is provided with a gas inlet 80 and a gas connection 82 for fixing the chamber 78 to a gas supply line 84 extending from a gas source (not shown). A valve 86, shown diagrammatically in FIGS. 1 and 6, is disposed in the gas supply line 84, and typically is mounted on the range, either on the upper surface thereof, alongside the burner, or on a vertical surface, often alongside an oven door.

Figure 7:
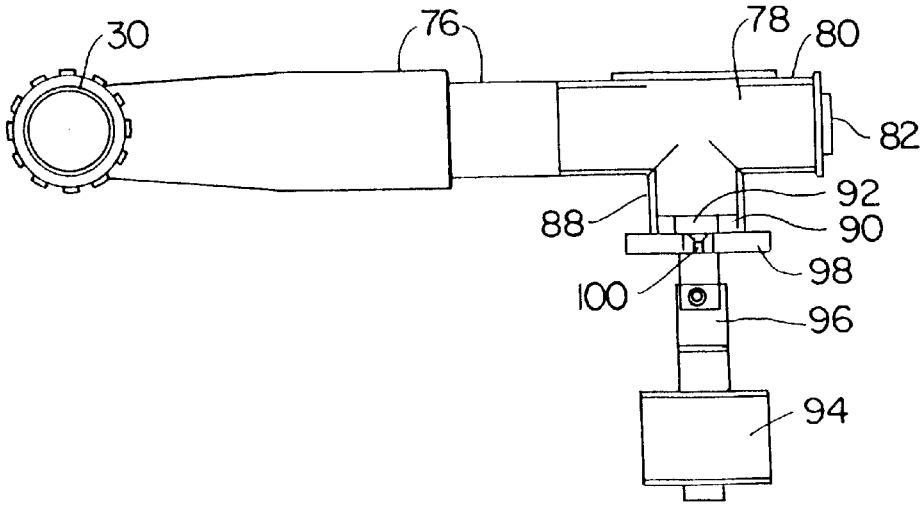
FIGS. 7 and 8 are top views of the mixing device and turn down assembly of FIG. 6, constituting a portion of the range.
Figure 8:
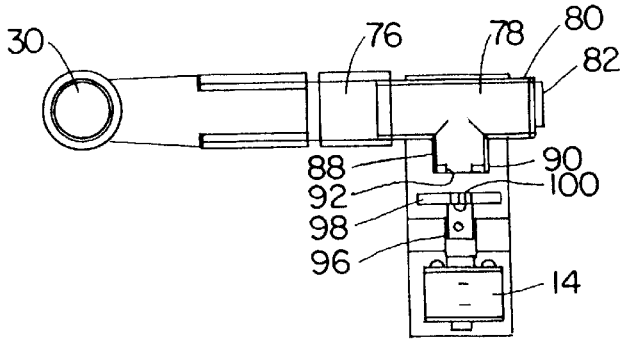

Referring still to FIGS. 7 and 8, it will be seen that the entry chamber 78 is provided with an air inlet 88, including a disc 90 having an orifice 92 through which ambient air may pass to enter the entry chamber 78. Alongside the entry chamber 78 is a solenoid valve 94 having a solenoid rod 96 extending therefrom. The solenoid rod 96 is spring-biased in a direction outwardly from the solenoid and toward the air inlet 88. Fixed to a distal end of the solenoid rod 96 is a pad 98 of a compliant material, such as Teflon, and having therethrough and in alignment with the disc orifice 92, an orifice 100 substantially smaller in diameter than the orifice 92. The orifice 92 is of a size providing for appropriate air flow at the maximum gas flow rate. The pad 98 is of a size sufficient to cover the disc orifice 92.

Figure 9:
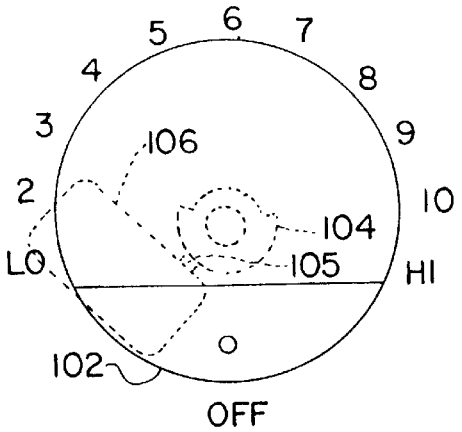
FIGS. 9–11 are top plan views of a control assembly used in conjunction with the mixing device and turn down assembly of FIGS. 6–8.
Figure 10:
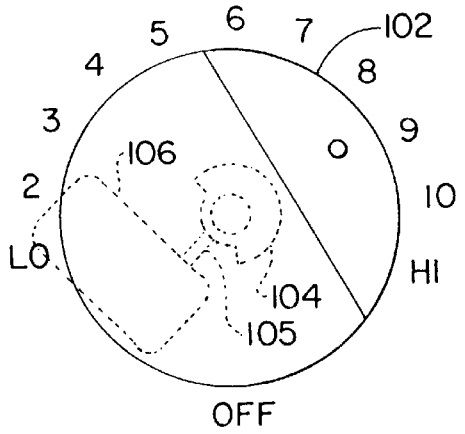
Figure 11:
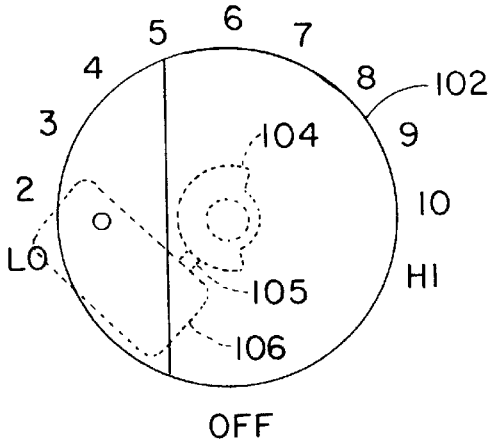

In FIGS. 9–11, there is shown an actuator 102 for the valve 86 with typical legends "LO" to "HI" thereon, indicating minimum flame intensity (switch at "LO"), progressively higher intensities ("2"–"10"), and the maximum intensity ("HI"). The valve 86 operates directly on the flow of gas through the gas supply line 84 to the mixing tube 76. If the actuator 102, and thereby the valve 86, is initially turned to "HI", maximum gas flow will follow, inducing air flow through the orifice 92 into the mixing tube 76.

It is known that the amount of air required for proper combustion of natural gas can vary over a broad range, provided that the air flow rate is at least equal to that required for stoichiometric combustion. As the valve 86 is moved by an operator from "HI" to "9" (FIG. 9) and/or to lower numbers, the inlet air flow rate is more or less stable. As the gas flow rate declines, by action of the valve 86, the amount of gas available to the burners decreases, while the air flow rate remains substantially unchanged. Eventually, however, the gas-to-air ratio is such as to reduce the flame temperature to a point too low to sustain combustion.

When the point is approached at which the mixture of air and gas is too heavy with air and too light with gas to sustain combustion, a cam member 104, which turns with the valve actuator 102, depresses a plunger 105 of a microswitch 106 (FIG. 11). The microswitch 106 is operative to turn off the solenoid 94, to permit the solenoid rod 96 and pad 98, to move under spring bias toward the air inlet 88. The pad 98 covers the air inlet orifice 92 (FIG. 7), but permits air to enter the mixing tube 76 through the smaller orifice 100. The smaller orifice 100 permits substantially less air therethrough than does the orifice 92. Thus, the in-flow of air is instantly reduced, returning the ratio of gas to air to permit near stoichiometric conditions to be restabilized at the lower gas rates of flow. Still further reductions toward and to "LO" in the gas flow rate are then possible, thereby increasing the overall "turndown" capability of the burners.

There is thus provided a wide range of flame intensities available. While it is known to reduce or increase both air and gas flow simultaneously, to increase or decrease flame intensity, mechanisms permitting such facility are notably expensive. The above-described "turndown" system provides a nearly equal performance at a greatly reduced cost.

Alternatively, a gas/air mixing valve, similar to that shown and described in U.S. Pat. No. 4,960,377, issued Oct. 2, 1990, in the names of Maurice Nunes, et al, and incorporated herein by reference, may be substituted for the valve 86, for regulating the flow of combustion air and gas to a burner of a cooking range.

To start the range 20, the actuator 102 is moved by an operator from "OFF" (FIG. 9) to a selected number. Assuming for illustrative purposes, that the actuator is moved to "9" (FIG. 10), the gas valve 86 is opened nearly fully to permit close to maximum flow rate of gas into the mixing tuber 76. The solenoid valve 94 is turned on and holds the rod 96 and pad 98 in a position removed from the disc 90 (FIG. 8) to permit the maximum flow rate of air through orifice 92 into the mixing tube 76. A gas/air mixture leaves the mixing tube 76 and travels through the fuel mixture inlet 30, into the receiving chamber 28 (FIG. 2), where the fuel mixture is dispersed by the baffle 31, and through the apertures 38 (FIGS. 3–5) to the combustion chamber 32.

The igniter 42 ignites the fuel mixture entering the combustion chamber 32. The resulting nonluminous flame is sustained by incoming fuel mixture and is disposed adjacent the loops or coils of the metal wire 44. The apertures 38 are of sufficient size to permit passage of the gas and air at maximum flow rates. While some of the apertures 38 may have portions of the metal wire 44 extending therethrough, the small diameter (0.005–0.020 inch) of the wire leaves room for passage of fuel mixture therethrough. Because the metal wire 44 is of relatively low mass and the large number of apertures 38 permit a high degree of port loading, that is, the passage of high BTU through the apertures 38, the metal wire 44 is heated very quickly. Within three seconds, and typically in about two seconds, the metal wire in the combustion chamber 32 reaches 1600° F.–2200° F. The wire radiates heat to the cover member 52. In addition, the heat of the combustion gases in the combustion chamber heat the cover member by convection before being exhausted.

The blower 72 draws the combustion gases from the combustion chambers 32 and directs the combustion gases out the exhaust outlet 74. The blower 72 operates continuously while the actuator is "ON" and induces a negative pressure in the combustion chamber 32 of about −0.2 to −0.3 inch $H_2O$, which, in turn, draws the cover member 52 down into sealing engagement with the peripheries of the burners, preventing escape of combustion gases therebetween.

The cover member 52 is heat transmissive and can support a continuous temperature of about 1800° F. The cover members each support on an upper surface thereof heat consuming items, such as utensils for foodstuffs to be heated or cooked. Such utensils receive heat by way of direct radiation transmitted through the cover number 52, by re-radiation of heat absorbed by the cover member 52, and by direct conduction from the cover member to the utensil in the area of contact therebetween.

When the actuator is turned down, as to "6", the flow rate of gas to the mixing tube 76 is progressively reduced, while the flow rate for air entering the mixing tube remains substantially the same. The reduction in the gas flow rate reduces the intensity of the flame, which reduces the temperature of the wire 44 and, thereby, the cover member 52. Further reduction of the gas flow rate without reduction of the air flow rate would result in extinguishment of the flame. At a preselected point, typically at about 5½, or between the "6" and "5" labels on the actuator, the actuator cam member 104 depresses the plunger 105 of the microswitch 106, which deactivates the solenoid valve 94, permitting the rod 96 and pad 98 to move under a spring bias toward the air inlet 88 of the mixing tube 76 to close in part the air inlet disc orifice 92 (FIG. 7) while making available the pad orifice 100, to reduce the flow rate of incoming air. The actuator 102 may then be turned to "2" or "LO", for example (FIG. 11), which will further progressively lower the gas flow rate while the air flow rate is maintained substantially constant.

When the actuator is moved back toward "HI", the reverse occurs. The gas flow rate is progressively increased and the air flow rate is increased one time at about the 5½ area on the actuator scale, or when the flame is at about 40% maximum intensity. Again, because the mass of the metal wire 44 is relatively slight, the temperature of the wire quickly changes in response to changes in flame intensity.

There is thus provided a heat supplying device, such as a cooking range, having at least one burner adapted to operate on a gaseous fuel and which, in combination with a cover member, presents a smooth top for supporting items to be heated or cooked.

There is further provided such a device wherein a negative pressure is maintained in the burner to draw the cover member into sealing engagement with the burner.

There is still further provided a control assembly for such a device, which permits adjustment of flame intensity through a wide range.

There is further provided a burner which operates on a gaseous fuel and which permits use of a smooth cover of heat transmissive material which provides an aesthetically pleasing appearance and an easy-to-clean top surface for supporting items to be heated or cooked.

Figure 13:
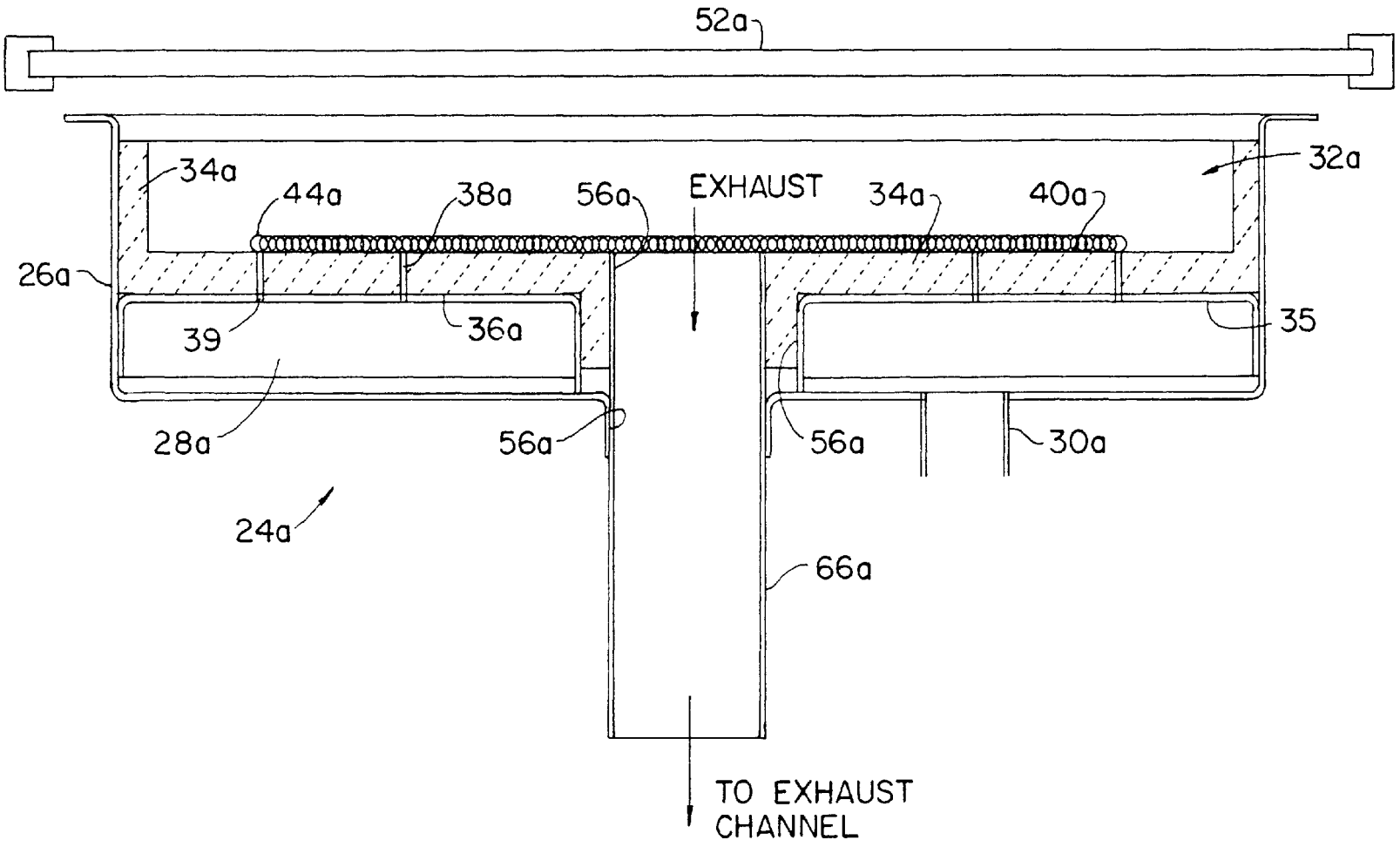
FIG. 13 is similar to FIG. 2, but illustrative of an alternative embodiment of cooking range.
Figure 14:
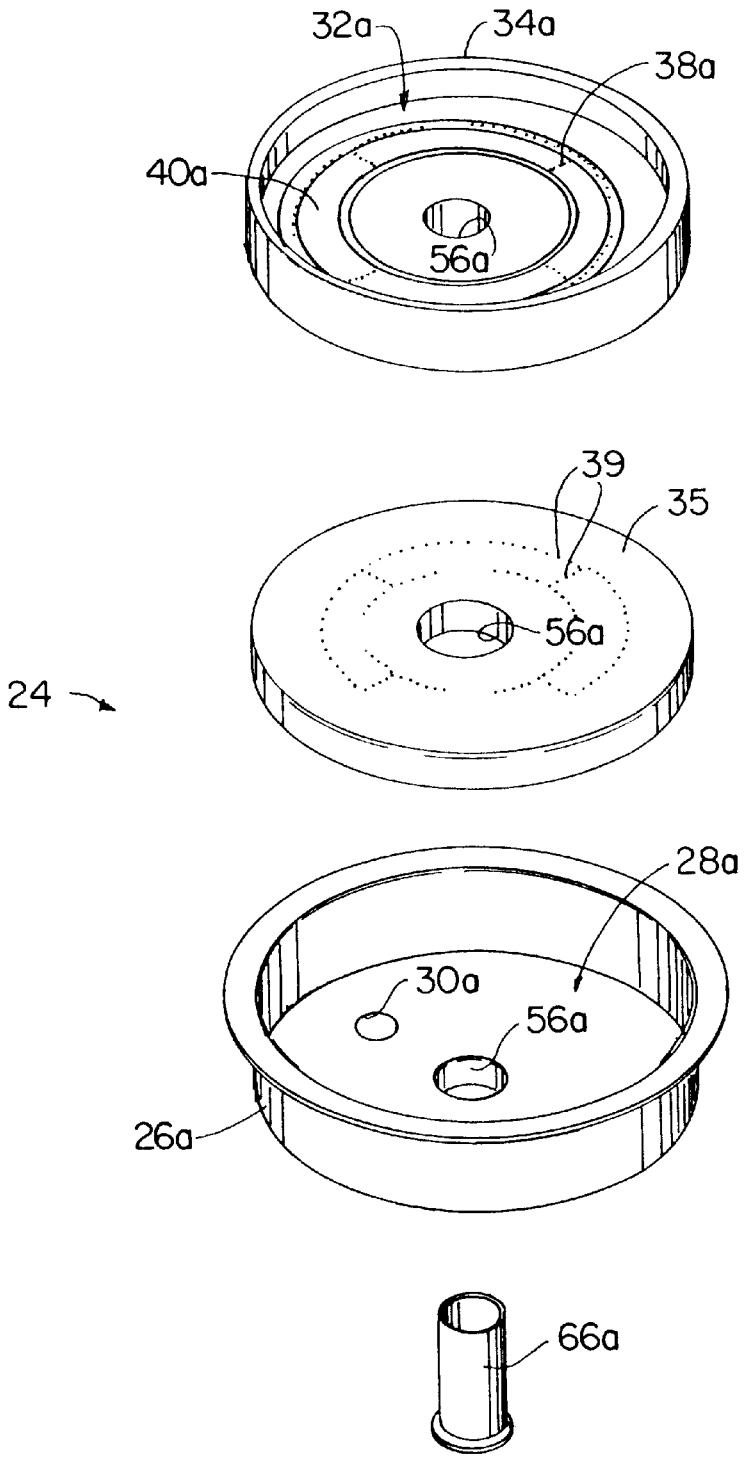
FIG. 14 is an exploded perspective view of an alternative embodiment of burner assembly.

Referring to FIGS. 13 and 14, it will be seen that an alternative burner 24*a* includes a shell 26*a* defining in part a chamber 28*a* for receiving gas and air mixture from fuel mixture inlet 30*a*. The shell 26*a* further defines in part a combustion chamber 32*a* in which a flame is sustained as desired.

An annular air/gas plenum 35 is disposed in the chamber 28*a* and is in communication with the fuel mixture inlet 30*a*. A substrate 34*a*, of the aforementioned rigid, high temperature material, is disposed in the shell 26*a* and overlies the plenur 35 and the gas and air mixture receiving chamber 28*a*, a bottom surface 36*a* of the substrate 34*a* overlying the plenum 35, and a top surface 40*a* of the substrate 34*a* defining in part the combustion chamber 32*a*.

The substrate 34*a* is provided with a multiplicity of apertures 38*a* extending therethrough, which permit passage of gas and air from the chamber 28*a* to the combustion chamber 32*a* through apertures 39 in the plenum 35 aligned with the substrate apertures 38*a*. High temperature metal wire 44*a* overlies the substrate top surface 40*a*. A cover member 52*a* of the aforementioned heat transmissive material closes the combustion chamber 32*a* an overlies the metal wire 44*a*.

The shell 26*a*, substrate 34*a*, and plenum 35 are each provided with a central opening 56*a*. The openings 56*a* are in axial alignment as shown in FIG. 13, and have disposed therein an exhaust tube 66*a* in communication with an exhaust manifold 68.

Figure 15:
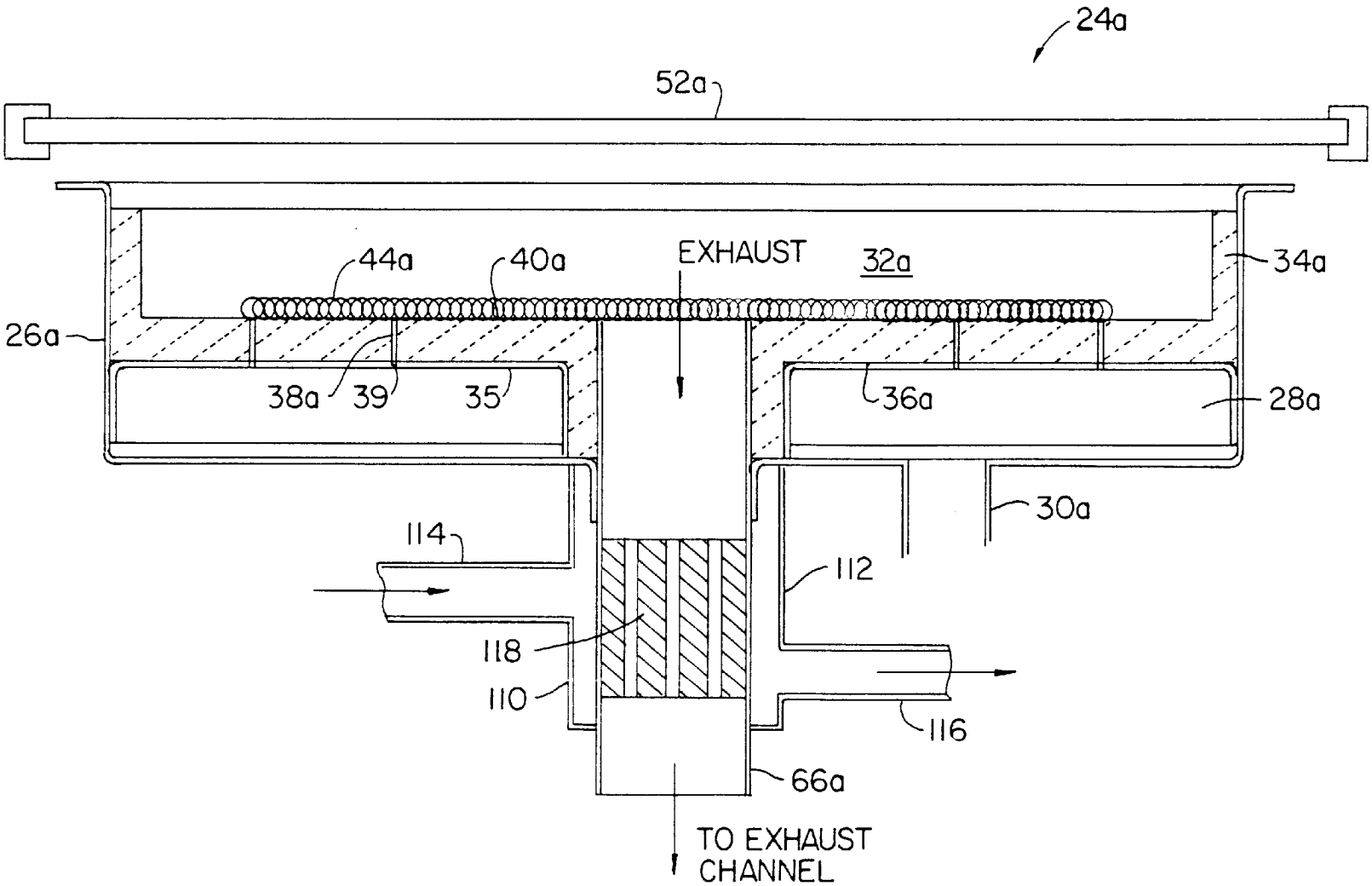
FIG. 15 is similar to FIG. 13, but illustrative of another alternative embodiment of cooking range.

Referring to FIG. 15, it will be seen that the burner 24*a* may be provided with a recuperator 110 including a sleeve 112 disposed around the exhaust tube 66*a*. The sleeve 110 is in communication with an air inlet tube 114 and an air outlet tube 116, such that air for use in the air/gas combustion mixture is flowed around the exhaust tube 66*a*, which serves to heat the air and cool the exhaust gases. The air outlet tube 116 flows the heated air from the receperator 110 to the air inlet of the mixing tube 76 which, in turn, directs the air/gas mixture to the fuel mixture inlet 30*a*.

The embodiment of burner shown in FIG. 15 may be provided with a catalytic converter 118 for removal or reduction of undesirable substances from the exhaust gases, such as carbon monoxide and nitrous oxide. With the converter 118 in the burner assembly, the venting of exhaust gases indoors is an option.

It is to be understood that the present invention is by no means limited to the particular construction herein disclosed and/or shown in the drawings, but also comprises any modifications or equivalents within the scope of the claims.

What is claimed is:

1. A cooking range comprising:

support structure for supporting at least one burner;

a burner mounted on said support structure, said burner comprising a chamber for receiving a gas and air mixture, a substrate having a bottom surface in part defining said chamber and having apertures therethrough for passage of the gas and air mixture therethrough, a combustion chamber defined in part by a top surface of said substrate, an igniter in said combustion chamber for igniting the gas and air mixture, and a high temperature metal wire disposed proximate said top surface of said substrate for radiating heat, wherein said metal wire comprises loops formed of said wire, said loops being disposed adjacent said top surface of said substrate, and wherein portions of said wire extend through said substrate; and a cover member of heat transmissive material overlying said metal wire and providing a support surface for items to be heated.

2. The cooking range in accordance with claim 1 wherein said metal wire is at least one coil of wire mounted on said substrate top surface.

3. The cooking range in accordance with claim 2 wherein said coil of wire is attached to said substrate top surface.

4. The cooking range in accordance with claim 1 wherein said metal wire is disposed in said combustion chamber and said gas and air mixture is burned in said combustion chamber adjacent said wire.

5. A cooking range comprising:

a housing;

a gas supply inlet and valve therefor;

a burner fixed in said housing and comprising a substrate defining a plurality of openings therethrough for flow therethrough of a mixture of air from said air supply inlet and gas from said gas supply inlet, the flow extending from a first side of said substrate to a second side of said substrate for combustion adjacent said second side of said substrate;

a high temperature metal wire disposed adjacent said second side of said substrate and projecting outwardly therefrom and heated by said combustion; and a cover of heat transmissive material disposed on said housing and overlying said metal wire to provide a support surface on the heat-supplying device for supporting a heat-consuming item, said metal wire radiating heat to said cover and extending through some of said openings and forming loops adjacent said second side of said substrate.

6. The heat supplying device in accordance with claim 5 wherein said wire comprises at least one coil of wire disposed adjacent said second side of said substrate.

7. The heat supplying device in accordance with claim 5 wherein said metal wire is adapted to transfer by radiation to said cover a temperature of about 1400° F.–2200° F.

8. The heat supplying device in accordance with claim 7 wherein said burner reaches a radiant temperature of about 1400° F.–2200° F. in about two seconds after combustion.

9. The heat supplying device in accordance with claim 5 wherein said substrate is of a material selected from a group of materials consisting of thermally insulating material, thermally conductive material, and a combination of thermally insulating material and thermally conductive material.

10. A cooking range comprising:

support structure for supporting at least one burner;

a burner mounted on said support structure, said burner being provided with a combustion chamber for housing combustion of a fuel, the burner having a substrate provided with a plurality of holes therethrough and a high temperature metal wire extending through said holes and forming loops on a side of said substrate;

a cover member of heat transmissive material overlying said combustion chamber and providing a support surface for items to be heated; and an exhaust blower in communication with said combustion chamber to draw exhaust gases from said combustion chamber, and for maintaining negative pressure in said combustion chamber to pull said cover member toward said burner to sealingly engage a portion of said burner.

11. The cooking range in accordance with claim 10 wherein said burner further comprises a high temperature wire disposed in said combustion chamber for radiating heat therefrom.

12. The cooking range in accordance with claim 10 wherein the negative pressure maintained in said combustion chamber is about −0.1 to −0.9 inch $H_2O$.

13. The cooking range in accordance with claim 12 wherein said exhaust blower is in communication with an exhaust conduit for conveying the exhaust gases from the cooking range.

14. The cooking range in accordance with claim 13 wherein said exhaust conduit extends outside an enclosure in which the cooking range is disposed.

15. A cooking range comprising:

support structure for supporting at least one burner;

a gas-fueled burner mounted on said support structure, said burner being provided with a combustion chamber for receiving a gas and air mixture;

an igniter mounted in said combustion chamber for igniting the gas and air mixture to provide a flame;

a mixing chamber for receiving gas and air from a gas inlet and an air inlet, respectively, for mixing the gas and air and discharging the mixture to conduit means in communication with said combustion chamber; and a control assembly for reducing the flame from a selected intensity to a selected lesser intensity and for increasing the flame from a selected intensity to a selected greater intensity, said control assembly comprising an actuator in communication with a gas valve and an air inlet valve, said actuator being operative, upon operation to reduce the flame intensity, to progressively reduce the flow rate of gas through said gas inlet to said mixing chamber to progressively reduce the intensity of the flame to about 10% of a maximum intensity, and upon further operation to reduce the flame intensity is operative to substantially reduce the flow rate of air through said air inlet and further progressively reduce the flow rate of gas through said gas inlet to said mixing chamber to further progressively reduce the intensity of the flame, said actuator being operative, upon operation to increase the intensity of the flame, to progressively increase the flow rate of gas through said gas inlet to said mixing chamber to progressively increase the intensity of the flame to about 40% of the maximum intensity, and upon further operation to increase the flame intensity, is operative to further progressively increase the flow rate of gas through said gas inlet and to substantially increase the flow rate of air through said air inlet and to said mixing chamber to further progressively increase the intensity of the flame.

16. The cooking range in accordance with claim 15 wherein said control assembly is operative to vary the flow rate of gas to said mixing chamber in selected and progressive increments and is operative to change the flow rate of air to said mixing chamber only at a fixed point in operation of said actuator.

17. The cooking range in accordance with claim 16 wherein said air inlet comprises first and second inlet orifices of different sizes and said air inlet valve is operative to render one of said orifices flow rate determinative and the other of said orifices non-flow rate determinative, to vary flow rate of air through said air inlet.

18. A control assembly for selectively varying intensity of a flame produced by combustion of a gas and air mixture by selectively varying flow rate of gas to a mixing chamber, and varying flow rate of air to the mixing chamber, the control assembly comprising:

an actuator operable in a first direction to decrease the flame intensity and in a second direction to increase the flame intensity;

a gas valve in a gas conduit in communication with said mixing chamber for varying the flow rate of gas to said mixing chamber; and an air valve in communication with said mixing chamber and adapted to vary the flow rate of air to said mixing chamber;

said actuator being in communication with said gas valve and said air valve;

wherein upon operating said actuator in the first direction, said actuator effects progressive closing of said gas valve to progressively decrease the flow rate of gas to said mixing chamber; and wherein upon further operation of said actuator in the first direction, said actuator reaches a point at which said actuator effects operation of said air valve to close off at least a portion of a first air inlet orifice to said mixing chamber and substitute therefor a smaller second air inlet orifice, to substantially reduce the flow rate of air to said mixing chamber; and wherein upon operating said actuator in the second direction, said actuator effects progressive opening of said gas valve to progressively increase the flow rate of gas to said mixing chamber; and wherein upon further operation of said actuator in the second direction, said actuator reaches the point at which said actuator effects operation of said air valve to remove the second air inlet orifice from communication with said mixing chamber and leave the larger first air inlet orifice in communication with the mixing chamber, to substantially increase the flow rate of air to said mixing chamber.

19. A burner for a heat-supplying device, the burner comprising:

a substrate defining a plurality of openings therethrough for flow of a mixture of gas and air therethrough from a first side of said substrate to a second side of said substrate for combustion adjacent to said second side of said substrate;

a high temperature metal wire disposed adjacent said second side of said substrate and projecting outwardly therefrom, wherein said substrate is provided with a plurality of holes therethrough and said metal wire extends through said holes and forms loops on said second side of said substrate; and a cover of heat transmissive material overlying said metal wire and defining a support surface on the heat-supplying device for supporting a heat-consuming item.

20. The burner in accordance with claim 19 wherein said substrate is of a material selected from a group of materials consisting of low density alumina oxide, corderite, and compressed alumina fibers.

21. The burner in accordance with claim 20 wherein said substrate is about ½–¾ inch thick from said first side to said second side.

22. The burner in accordance with claim 19 wherein said high temperature metal wire is of a material selected from a group of materials consisting of kanthal, chromel, nichrome, and alloys thereof.

23. The burner in accordance with claim 22 wherein said wire is of a diameter of about 0.005–0.020 inch.

24. The burner in accordance with claim 23 wherein said metal wire is adapted to transfer by radiation to said cover a temperature of about 1400° F.–1800° F.

25. The burner in accordance with claim 24 wherein said cover is of a glass/ceramic material.

26. The burner in accordance with claim 24 wherein said burner reaches said temperature of about 1400° F.–2200° F. in about three seconds after combustion.

27. The burner in accordance with claim 19 wherein said loops upstand from said second side of said substrate by about ¼ inch.

28. The burner in accordance with claim 19 wherein said wire comprises coils of wire disposed on said second side of said substrate.

29. The burner in accordance with claim 28 wherein said coils of wire are provided with an outside diameter of about ¼ inch.

30. The burner in accordance with claim 28 wherein said coils of wire are disposed adjacent said openings.

31. The burner in accordance with claim 19 wherein said openings are of a size selected to support a selected maximum velocity of the air/gas mixture flowed therethrough, insuring the combustion adjacent the second side of said substrate and within an area occupied by said metal wire.

32. The burner in accordance with claim 19 wherein said burner further comprises an exhaust tube in communication with said combustion chamber for flowing exhaust gases from said combustion chamber to an exhaust channel.

33. The burner in accordance with claim 32 wherein said burner further comprises a recuperator mounted on said exhaust tube for flowing incoming air around said exhaust tube to increase the heat of the air and flowing the heated air therefrom and toward the substrate openings.

34. The burner in accordance with claim 33 wherein said burner further comprises a catalytic converter mounted in said exhaust tube.

35. The burner for a heat-supplying device in accordance with claim 19 wherein said substrate is of a material selected from a group of materials consisting of thermally insulating material, thermally conductive material, and a combination of thermally insulating material and thermally conductive material.

* * * * *